US007219937B2

(12) United States Patent
Stöber et al.

(10) Patent No.: US 7,219,937 B2
(45) Date of Patent: May 22, 2007

(54) SUSPENSION FOR LOAD HOOKS

(75) Inventors: Manfred Stöber, Witten (DE); Klaus-Jürgen Winter, Wetter (DE); Karl Zacharias, Schwerte (DE)

(73) Assignee: Demag Cranes & Components GmbH, Wetter (DE)

( * ) Notice: Subject to any disclaimer, the term of this patent is extended or adjusted under 35 U.S.C. 154(b) by 178 days.

(21) Appl. No.: 10/792,188

(22) Filed: Mar. 3, 2004

(65) Prior Publication Data

US 2004/0189033 A1 Sep. 30, 2004

(30) Foreign Application Priority Data

Mar. 6, 2003 (DE) ..... 103 10 087

(51) Int. Cl.
*B66C 1/34* (2006.01)

(52) U.S. Cl. ..... 294/82.1; 384/617

(58) Field of Classification Search ..... 294/82.1, 294/82.11, 82.15; 384/609, 617, 9
See application file for complete search history.

(56) References Cited

U.S. PATENT DOCUMENTS

| | | | | |
|---|---|---|---|---|
| 2,500,459 | A * | 3/1950 | Hoover et al. | 267/127 |
| 2,625,005 | A * | 1/1953 | Myers | 59/95 |
| 2,823,944 | A * | 2/1958 | Anderson et al. | 294/82.15 |
| 4,308,419 | A | 12/1981 | Fredriksson | 174/185 |
| 4,708,382 | A * | 11/1987 | LaCount | 294/82.1 |
| 5,851,039 | A * | 12/1998 | Fanger et al. | 294/82.1 |

FOREIGN PATENT DOCUMENTS

| | | |
|---|---|---|
| DE | 725114 | 9/1942 |
| DE | 882606 | 7/1953 |
| DE | 274806 | 1/1990 |
| DE | 274806 A1 | 1/1990 |
| DE | 19817011 C2 | 4/2000 |
| FR | 920416 | 4/1947 |

OTHER PUBLICATIONS

Search Report from corresponding European Application No. EP 04 00 4899, dated Aug. 12, 2004.

* cited by examiner

*Primary Examiner*—Eileen D. Lillis
*Assistant Examiner*—Esther Onyinyechi Okezie
(74) *Attorney, Agent, or Firm*—Van Dyke, Gardner, Linn & Burkhart, LLP

(57) ABSTRACT

The invention concerns a suspension for load hooks, especially for lower blocks of cable controls, with a shaft mounted in a recess of a carrier body and able to turn about a vertical axis, which is mounted in a continuous bore of a support element and thrusts against the carrier body by means of at least one axial bearing. In order to create a short and simple construction of a suspension for a load hook, the invention proposes that the shaft of the load hook is mounted in the carrier body by a bearing arrangement consisting of the support element, at least one axial bearing, and the retaining ring surrounding the shaft, and the bearing arrangement is secured by a fastening element, especially a snap-ring, in the carrier body.

37 Claims, 5 Drawing Sheets

SUSPENSION FOR LOAD HOOKS

BACKGROUND OF THE INVENTION

The invention concerns a suspension for load hooks, especially for lower blocks of cable actuators, with a shaft able to turn about a vertical axis in a recess of a carrier body, being mounted in a continuous bore of a supporting element and abutting against the carrier body across at least one axial bearing.

Suspensions for load hooks are known from practice in the most diverse configurations. From DIN 15 411, there is known a lower block with two cable rollers, in which the load hook can turn about a vertical and a horizontal axis and is mounted on a load hook suspension, which is arranged underneath the connection body which carries the cable rollers. Because of the use of the connection body, on the one hand, and the separate load hook suspension, on the other, this familiar design has a relatively large structural height and, moreover, a lot of structural parts.

A generic load hook suspension is known from German Patent No. DE 196 02 931 C2. In this suspension, the shaft of the load hook is mounted in a recess of the connection body, carrying the cable rollers, of a lower block. The axial bearing installed in the recess and supporting the shaft of the load hook is held in the recess by tangentially arranged screws, which are screwed into tangential grooves of the bearing retainer from the cable rollers. Because of this tangential screw fastening of the axial bearing in the recess, the assembly process for this known suspension is very cumbersome and requires an exact positioning of the bearing retainer with the load hook mounted therein in the recess of the connection body, since the tangential screws can only be screwed in one position into the tangential grooves of the bearing retainer.

Another suspension for load hooks is known from German patent application No. DE 198 17 011 A1. In this known load hook suspension for a lower block, the load hook can turn about both a vertical and also a horizontal axis. For this, the bearing arrangement for the shaft of the load hook, arranged in the recess of the connection body carrying the cable rollers, comprises the axial bearing for the rotation about the vertical axis and also a cylindrical journal, which is mounted in the connection body so that it can turn and which spans the recess. To accommodate the shaft of the load hook, the cylindrical journal has a continuous bore. A nut is screwed onto the free end of the load hook shaft, protruding from the continuous bore, and the load hook is thus secured on the cylindrical journal. Due to the use of the cylindrical journal, the overall bearing arrangement has a relatively large structural height and, furthermore, consists of many parts not capable of preassembly.

SUMMARY OF THE INVENTION

Based on the foregoing, the problem of the invention is to create a short and simple design for a load hook suspension.

The solution of this problem is characterized, according to an aspect of the invention, in that the shaft of the load hook is mounted in the carrier body by a bearing arrangement consisting of the support element, at least one axial bearing, and the retaining ring surrounding the shaft. The bearing arrangement is fastened by a securing element, preferably the retaining ring, in the carrier body.

The bearing system of the invention makes it possible to reassemble the entire bearing arrangement before being installed in the recess of the carrier body. Furthermore, only one fastener element, such as a snap-ring, is required to secure the bearing arrangement in the recess. The assembly is thus easy and fast, especially since it does not require any particular positioning of the bearing arrangement relative to the carrier body and/or the recess.

The fastening element for securing the bearing arrangement may reach around an undercut of the carrier body, on the one hand, and thrusts against a bearing surface of the retainer ring, on the other. The overall bearing arrangement in this embodiment is mounted on the fastener element, which is supported against the carrier body. Advantageously, the undercut to accommodate the fastening element is in the form of a peripheral annular groove in the carrier body.

The securing of the load hook shaft on the support element, according to one preferred embodiment of the invention, occurs by way of a securing element, especially a snap-ring, which, in the assembled state, engages with an undercut at the free end of the shaft, on the one hand, and is arranged in a recess of the support element, on the other.

In a first practical embodiment, the undercut to accommodate the securing element is in the form of a peripheral annular groove in the load hook shaft.

In order to reduce the notch stresses which occur, according to a second embodiment, it is proposed that the undercut to accommodate the securing element is in the form of a tapering of the shaft cross section that progresses from the free end of the shaft.

Advantageously, the surface of the supporting element facing the axial bearing and/or the surface of the retaining ring is fashioned as a planar bearing surface for the axial bearing, which is fashioned in particular as an axial needle roller bearing.

According to an alternative embodiment of the invention, the support element itself forms the upper bearing shell of the axial bearing, which can further reduce the number of parts.

With a preferred modification of the invention, it is proposed that the load hook is mounted so that it can swivel about a horizontal axis in the carrier body, in addition to being able to rotate about the vertical axis. Due to this additional degree of freedom, the handling and possible use of a load hook mounted according to the invention can be substantially improved. This ability to swivel about a horizontal is axis is advantageously achieved by two cylindrical rollers, arranged between the lower shell of the axial bearing and the retaining ring, forming the horizontal swivel axis, with the cylindrical rollers being arranged opposite each other on both sides of the shaft of the load hook in the bearing arrangement.

The number of structural parts needed to form the bearing arrangement of the invention can be further reduced in that the cylindrical rollers are arranged between the retaining ring and a swivel bearing ring encircling the shaft and forming the lower shell of the axial bearing.

The swiveling about the horizontal axis can be facilitated, and also limited in the angle of swivel, in that, first, a gap is formed between the facing surfaces of the retaining ring and the swivel bearing ring in a plane perpendicular to the swivel axis, and, secondly, the side walls of the continuous bore of the retaining ring are conically enlarged in the direction of the load hook, at least in the swivel plane of the load hook.

The limiting of the swivel angle is made possible in that the facing surfaces of the retaining ring and the swivel bearing ring and/or the conical sidewalls of the continuous bore of the retaining ring form stopping surfaces limiting the angle of swivel of the load hook. The gap between the facing surfaces of the retaining ring and the swivel-bearing ring is advantageously configured to widen in the radially outward direction.

Finally, the invention proposes that the handling of the device provided with the load hook is facilitated by at least one recessed handle in the carrier body. The carrier body provided with at least one recessed handle, configured for example as a connection body for a lower block, can be easily and cheaply fabricated as a cast iron piece, whereas a forged load hook provided with a recessed handle, as is known from the state of the art, constitutes a costly and difficult to fabricate special part.

Further features and advantages of the invention result from the enclosed drawings, in which two sample embodiments of an invented suspension for load hooks are represented only in sample fashion.

These and other objects, advantages and features of this invention will become apparent upon review of the following specification in conjunction with the drawings.

DETAILED DESCRIPTION OF THE PREFERRED EMBODIMENT

Figure 1:
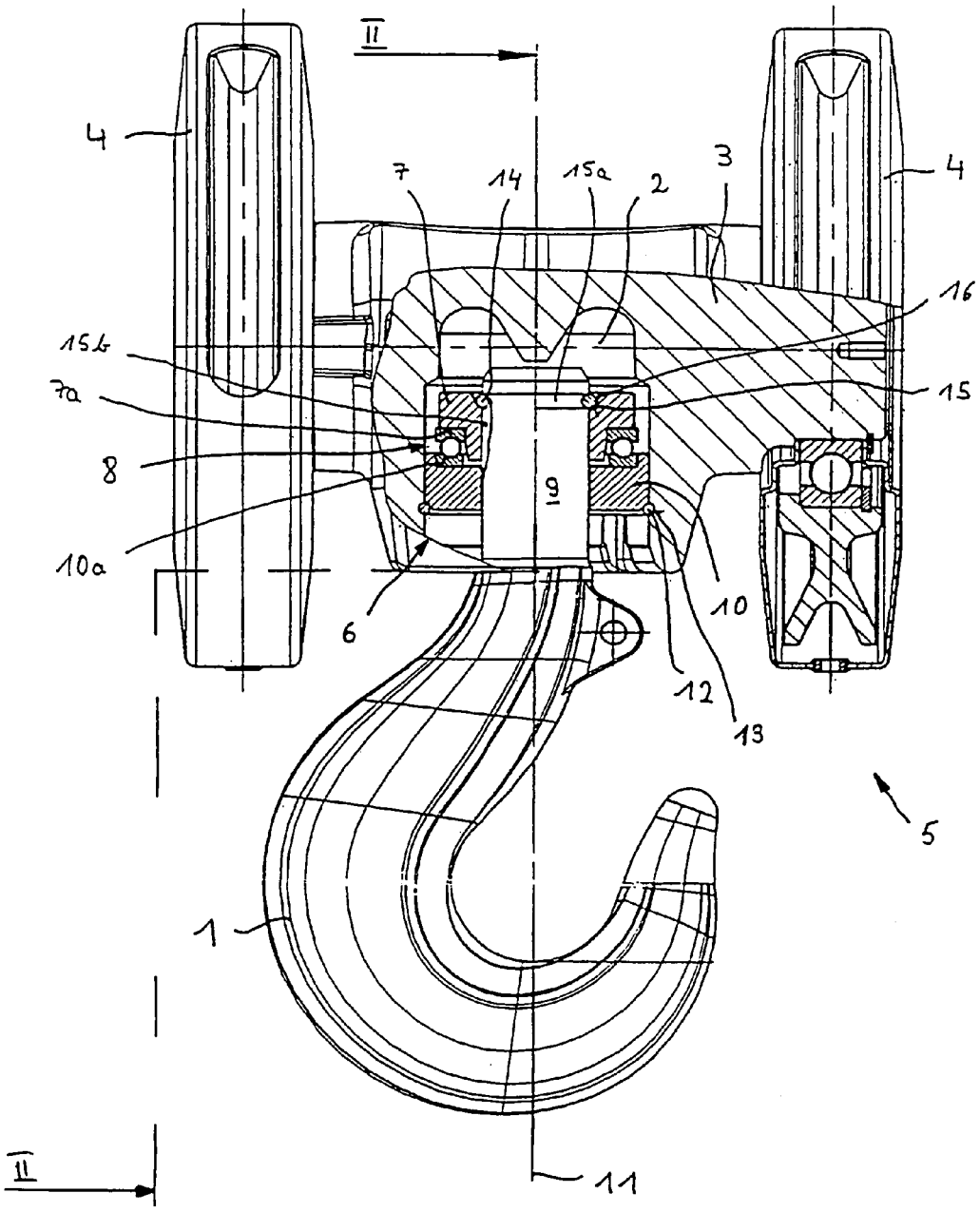
FIG. 1 is a partial cutaway front view of a load hook suspension arranged on a lower block according to a first embodiment of the invention.

Referring now to the drawings and the illustrative embodiments depicted therein, the representations of FIGS. 1 through 5 show two sample embodiments for the configuration of the suspension of a load hook 1, which is mounted in a recess 2 of a carrier body 3. In the sample embodiments depicted, the carrier body 3 is configured as a connection body carrying two cable rollers 4 of a lower block 5.

As is evident from the figures, a bearing arrangement 6 forming the suspension of the load hook 1 may include at least one annular support element 7, an axial bearing 8, as well as a retaining ring 10, encircling a shaft 9 of the load hook 1, wherein the load hook 1 is able to turn about a vertical axis 11 due to the use of the axial bearing 8. The overall bearing arrangement 6 mounted in the recess 2 of the carrier body 3 is held in the recess 2 of the carrier body 3 by a securing element 12.

This securing element 12, as represented in FIGS. 1 through 5, can be embodied, for example, as a snap-ring, which engages with an undercut 13, especially an annular groove, in the carrier body 3.

Figure 2:
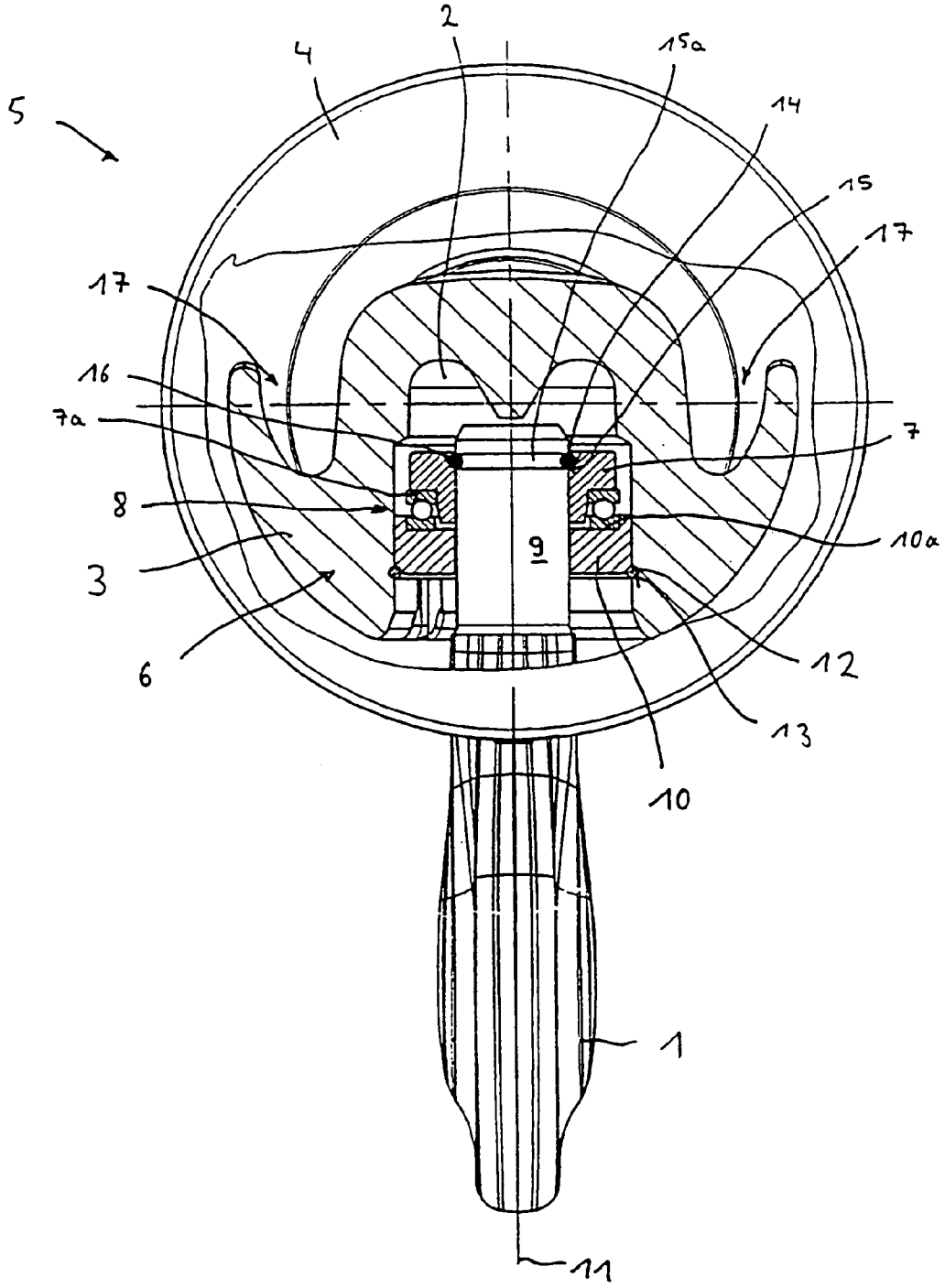
FIG. 2 is a sectional view taken along line II—II of FIG. 1.

In the first embodiment represented by FIGS. 1 and 2, the load hook 1 is mounted in the carrier body 3 so as to rotate only about the vertical axis 11. In this embodiment, both the support element 7 and the retaining ring 10 have planar bearing surfaces 7*a*, 10*a* for the mounting of the axial bearing 8, against which the shells of the axial bearing thrust.

The fastening of the shaft 9 of the load hook 1 occurs by a securing element 14, such as a snap-ring, which in the assembled condition engages with an undercut at the free end of the shaft 9, on the one hand, and is arranged in an indentation 16 of the support element 7, on the other hand. This construction has the benefit of allowing an especially short height for the bearing arrangement 6, since the free end of the shaft 9 only protrudes slightly beyond the upper edge of the support element 7. In the representation of FIG. 1, two embodiments are shown for configuring the undercut 15 to accommodate the securing element 14 on the shaft 9, although in practice, of course, only one embodiment will be used in one bearing arrangement 6.

On the right side half of the shaft 9, the undercut 15 receiving the securing element 14 is configured as a peripheral annular groove 15*a*, while the undercut 15 on the left half of the shaft 9 is configured as a tapering 15*b* of the cross section of the shaft. The tapering form 15*b* has the advantage that fewer notch stresses occur as compared to the peripheral groove 15*a*.

The cutaway side view per FIG. 2 reveals that recessed handles 17 are fashioned in the carrier body 3 to facilitate the handling. The forming of the recessed handle 17 on the carrier body 3 is especially advantageous, since a carrier body 3 provided with recessed handles 17 can be easily and cheaply produced as a cast iron part, while a forged load hook 1 provided with recessed handles 17, as is known from the state of the art, is a costly and difficult to produce special part.

Figure 3:
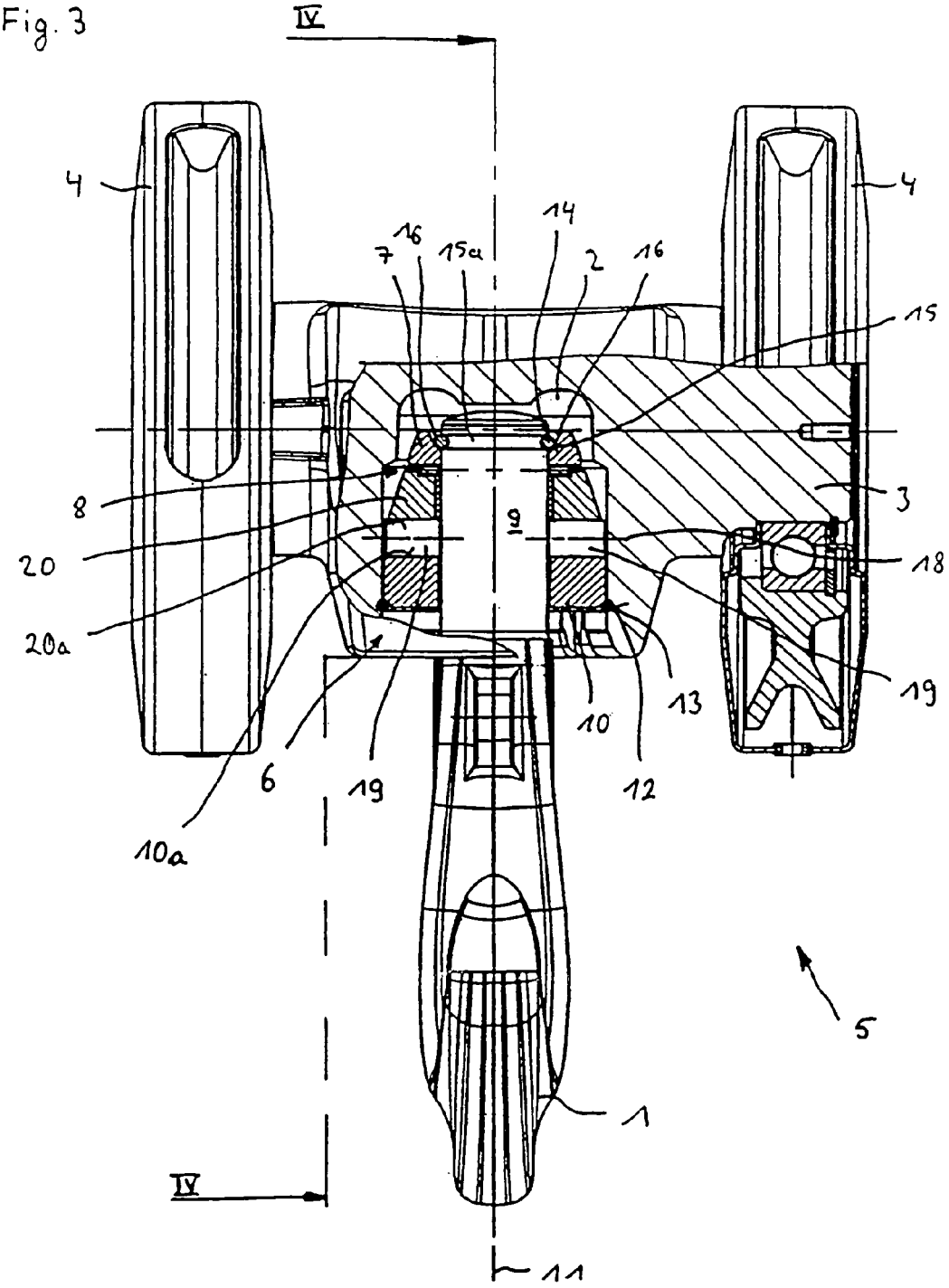
FIG. 3 is a partial cutaway front view of a load hook suspension arranged on a lower block according to a second embodiment of the invention.
Figure 4:
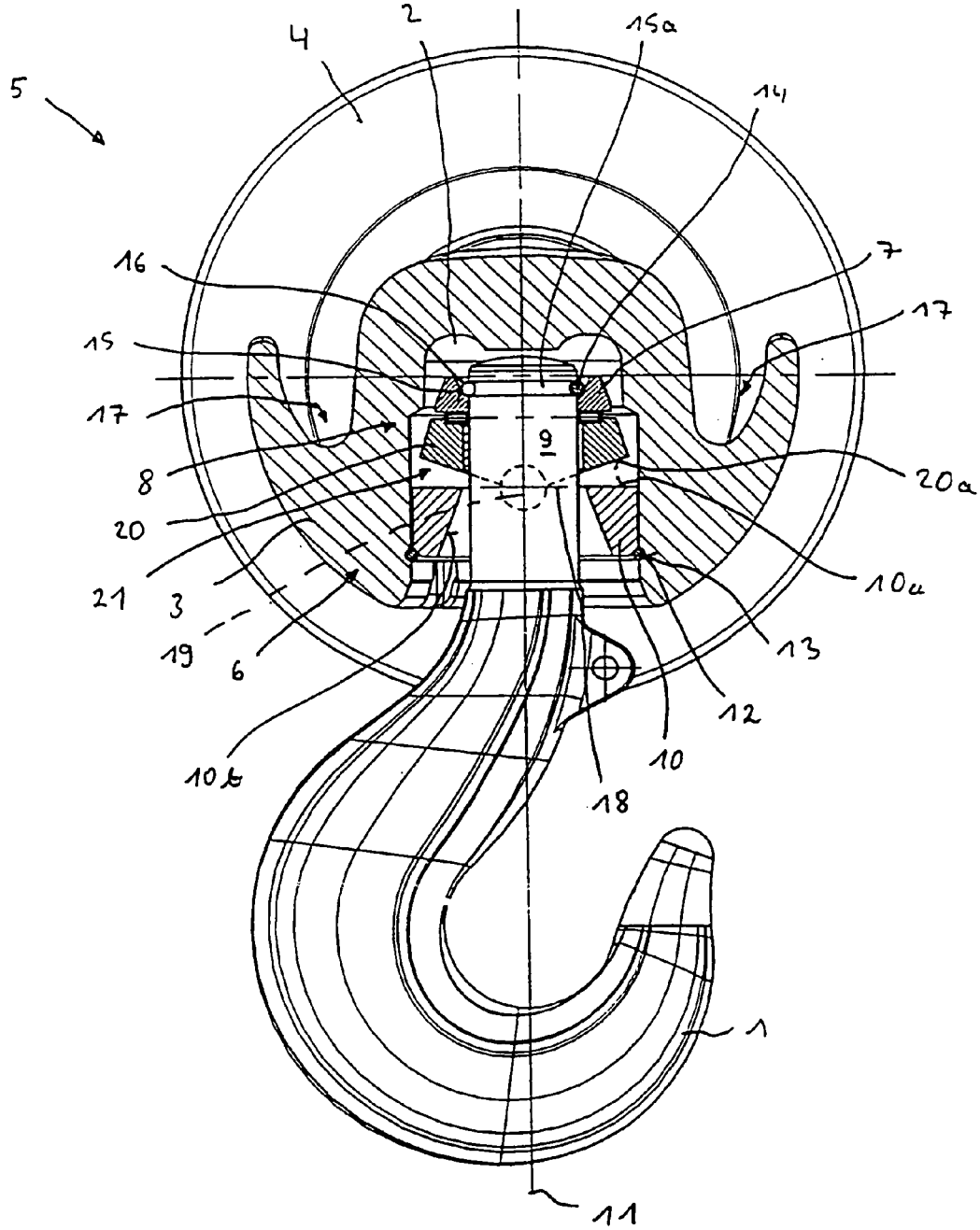
FIG. 4 is a sectional view taken along line IV—IV of FIG. 3.
Figure 5:
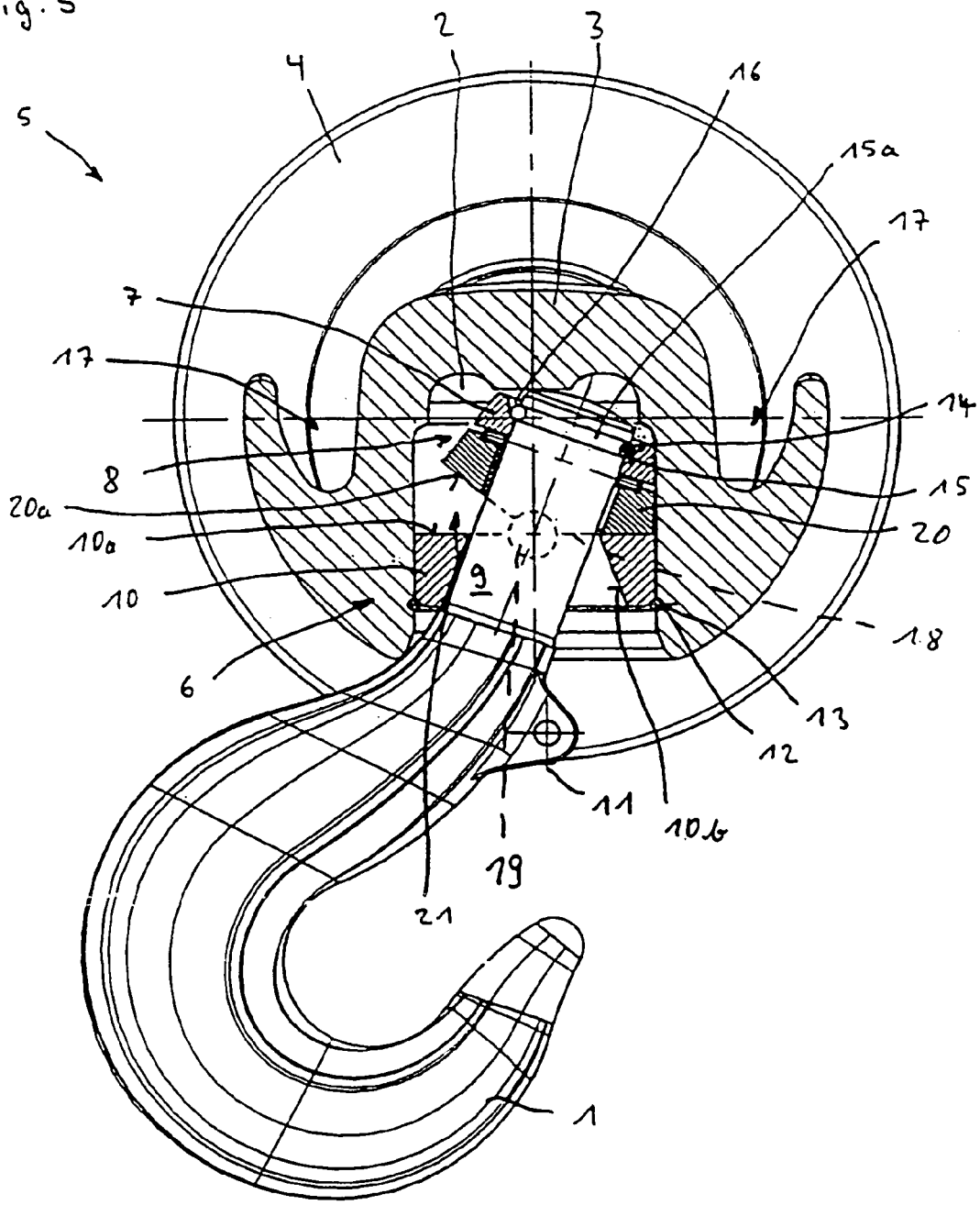
FIG. 5 is the same view as FIG. 4, but showing the load hook in a swiveled position.

The second embodiment represented in FIGS. 3 through 5 for the configuring of the suspension of a load hook 1 differs from the previously described embodiment essentially in that the load hook 1 is mounted in the carrier body 3 able to swivel about a horizontal axis 18, in addition to being able to turn about the vertical axis 11.

For this purpose, two cylindrical rollers 19 are arranged between the lower shell of the axial bearing 8 and the retaining ring 10, forming the horizontal swivel axis 18, and the cylindrical rollers 19 are arranged opposite each other on both sides of the shaft 9 of the load hook 1 in the bearing arrangement 6.

In the embodiment depicted, the cylindrical rollers 19 are arranged between the retaining ring 10 and a swivel-bearing ring 20 encircling the shaft 9 and forming the lower shell of the axial bearing 8. As is further evident from these figures, the support element 7, on the one hand, and the swivel bearing ring 20, on the other, form the shells of the axial bearing 8, whereas in the embodiment per FIGS. 1 and to 2, the axial bearing 8 had only one retainer proper.

In FIGS. 4 and 5, one will discern a specific configuration for the swivel bearing ring 20 and the retaining ring 10, whereby the load hook 1 can be easily swiveled about the axis 18, on the one hand, but also the angle of swivel can be limited, on the other hand.

As can be seen from FIGS. 4 and 5, a gap 21 is formed between the facing surfaces 10*a*, 20*a* of the retaining ring 10 and the swivel bearing ring 20 in a plane perpendicular to the swivel axis 18, enabling the two parts 10 and 20 to swivel relative to each other. The swivel angle of the load hook 1 can be adjusted in that the gap 21 is configured to widen in the radially outward direction. This outwardly broadening gap 21 can be produced in that, as represented in FIGS. 4 and 5, the bearing surface 20*a* of the swivel-bearing ring 20 is sloping relative to the bearing surface 10*a* of the retaining ring 10. Of course, it is also possible to make only the bearing surface 10*a* of the retaining ring 10 slanted relative to the bearing surface 20*a* of the swivel bearing ring 20, or to make both bearing surfaces 10*a*, 20*a* slanted.

Furthermore, side walls 10*b* are conically widened in the direction of the load hook 1, at least in the swivel plane of the load hook 1, in order to allow for the swiveling of the load hook 1.

The facing bearing surfaces 10*a*, 20*a* of the retaining ring 10 and the swivel-bearing ring 20 and/or the conical side-walls 10*b* of the retaining ring 10 thus form stopping surfaces, which limit the angle of swivel of the load, hook 1.

Such suspensions for load hooks 1 are distinguished by their compact construction with short structural height, on the one hand, and possess the advantage that the entire bearing arrangement 6 can be preassembled outside of the carrier body 3, on the other hand. For the actual assembly on the carrier body 3, it is only necessary to install the bearing arrangement 6, previously assembled on the shaft 9 of the load hook 1, into the recess 2 in the carrier body 3 and fasten the bearing arrangement 6 to the carrier body 3 by the securing element 12.

The embodiments of the invention in which an exclusive property or privilege is claimed are defined as follows:

1. A suspension for a load hook at a lower block of a cable actuator, comprising:

a shaft of the load hook mounted in a recess of a carrier body and able to turn about a vertical axis, wherein said shaft is mounted in a continuous bore of a support element and thrusts against the carrier body by at least one axial bearing;

said shaft being mounted in the carrier body by a bearing arrangement comprising said support element, said at least one axial bearing, and a retaining ring surrounding said shaft;

said bearing arrangement being secured by a fastening element in said carrier body;

wherein said retaining ring is fastened by a securing element in said carrier body; and wherein said securing element for securing the bearing arrangement engages an undercut of said carrier body and thrusts against a bearing surface of said retaining ring.

2. The suspension of claim 1 wherein said undercut is fashioned as a peripheral annular groove.

3. The suspension of claim 2 wherein said shaft of the load hook is secured on said support element by a securing element, which in the assembled condition engages an undercut at the free end of said shaft and is arranged in an indentation, of said support element.

4. The suspension of claim 3 wherein said undercut is fashioned as a peripheral annular groove.

5. The suspension of claim 3 wherein said undercut is configured as a tapering of the shaft cross section, proceeding from the free end of said shaft.

6. The suspension of claim 5 wherein at least one chosen from said support element and said retaining ring have a planar bearing surface for said axial bearing.

7. The suspension of claim 5 wherein said planar bearing surface comprises an axial needle roller bearing.

8. The suspension of claim 7 wherein said load hook is additionally mounted in said carrier body able to swivel about a horizontal axis.

9. The suspension of claim 8 including two cylindrical rollers arranged between a lower shell of said axial bearing and said retaining ring form the horizontal swivel axis, and said cylindrical rollers are arranged opposite each other at either end of said shaft of said load hook in the bearing arrangement.

10. The suspension of claim 9 wherein said cylindrical rollers are arranged between said retaining ring and a swivel bearing ring encircling said shaft and forming said lower shell of said axial bearing.

11. The suspension of claim 10 wherein a gap is formed between facing surfaces of said retaining ring and said swivel bearing ring in a plane perpendicular to the swivel axis.

12. The suspension of claim 11 wherein said gap is configured as enlarging in a radially outwardly direction.

13. The suspension of claim 12 wherein said side walls of the continuous bore of said retaining ring are configured to be conically enlarged in the direction of the load hook, at least in the swivel plane of the load hook.

14. The suspension of claim 13 wherein at least one chosen from said facing surfaces of said retaining ring, said swivel bearing ring and said conical side walls of said retaining ring form bearing surfaces limiting the swivel angle of said load hook.

15. The suspension of claim 14 including at least one recessed handle in said carrier body.

16. The suspension of claim 15 wherein said carrier body comprises a connection body carrying tow cable rollers of a lower block.

17. The suspension of claim 1 wherein said fastening element comprises a snap-ring.

18. The suspension of claim 3 wherein said securing element comprises a snap-ring.

19. The suspension of claim 6 wherein said planar bearing surface comprises an axial needle roller bearing.

20. A suspension for a load hook at a lower block of a cable actuator, comprising:

a shaft of the load hook mounted in a recess of a carrier body and able to turn about a vertical axis, wherein said shaft is mounted in a continuous bore of a support element and thrusts against the carrier body by at least one axial bearing;

said shaft being mounted in the carrier body by a bearing arrangement comprising said support element, said at least one axial bearing and a retaining ring surrounding said shaft;

said bearing arrangement being secured by a fastening element in said carrier body; and wherein said securing element for securing the bearing arrangement engages an undercut of said carrier body and thrusts against a bearing surface of said retaining ring.

21. The suspension of claim 20 wherein said undercut is fashioned as a peripheral annular groove.

22. The suspension of claim 1 wherein said shaft of the load hook is secured on said support element by a securing element, which in the assembled condition engages an undercut at the free end of said shaft and is arranged in an indentation of said support element.

23. The suspension of claim 22 wherein said securing element comprises a snap-ring.

24. The suspension of claim 22 wherein said undercut is fashioned as a peripheral annular groove.

25. The suspension of claim 22 wherein said undercut is configured as a tapering of the shaft cross section, proceeding from the free end of said shaft.

26. The suspension of claim 1 wherein at least one chosen from said support element and said retaining ring have a planar bearing surface for said axial bearing.

27. The suspension of claim 26 wherein said planar bearing surface comprises an axial needle roller bearing.

28. The suspension of claim 1 wherein said support element forms an upper shell of said axial bearing.

29. The suspension of claim 1 wherein said load hook is additionally mounted in said carrier body able to swivel about a horizontal axis.

30. The suspension of claim 29 including two cylindrical rollers arranged between a lower shell of said axial bearing and said retaining ring form the horizontal swivel axis, and said cylindrical rollers are arranged opposite each other at either end of said shaft of said load hook in the bearing arrangement.

31. The suspension of claim 30 wherein said cylindrical rollers are arranged between said retaining ring and a swivel bearing ring encircling said shaft and forming said lower shell of said axial bearing.

32. The suspension of claim 31 wherein a gap is formed between facing surfaces of said retaining ring and said swivel bearing ring in a plane perpendicular to the swivel axis.

33. The suspension of claim 32 wherein said gap is configured as enlarging in a radially outwardly direction.

34. The suspension of claim 30 wherein said side walls of the continuous bore of said retaining ring are configured to be conically enlarged in the direction of the load hook, at least in the swivel plane of the load hook.

35. The suspension of claim 30 wherein at least one chosen from said facing surfaces of said retaining ring, said swivel bearing ring and said conical side walls of said retaining ring form bearing surfaces limiting the swivel angle of said load hook.

36. The suspension of claim 1 including at least one recessed handle in said carrier body.

37. The suspension of claim 1 wherein said carrier body comprises a connection body carrying two cable rollers of a lower block.

* * * * *

UNITED STATES PATENT AND TRADEMARK OFFICE

CERTIFICATE OF CORRECTION

PATENT NO. : 7,219,937 B2
APPLICATION NO. : 10/792188
DATED : May 22, 2007
INVENTOR(S) : Manfred Stöber, Klaus-Jürgen Winter and Karl Zacharias It is certified that error appears in the above-identified patent and that said Letters Patent is hereby corrected as shown below:

Column 1:
Line 66, "reassembly" should be --preassembly--.

Column 2:
Line 44, delete "is" before "axis".

Column 4:
Line 46, "FIGS. 1 and to 2" should be --FIGS. 1 and 2--.

Column 5:
Claim 3, Line 47, delete "," after "indentation".
Claim 7, Lines 56-57, "planar bearing surface comprises an axial needle roller bearing" should be --support element forms an upper shell of said axial bearing.--.

Column 6:
Claim 16, Line 23, "tow" should be --two--.

Signed and Sealed this

Eighth Day of July, 2008

JON W. DUDAS
*Director of the United States Patent and Trademark Office*